US005819343A

United States Patent [19]

Zampirri, Jr. et al.

[11] Patent Number: 5,819,343

[45] Date of Patent: Oct. 13, 1998

[54] MULTI-PURPOSE COMBINATION BLANKET AND TOTE BAG

[76] Inventors: Dominic C. Zampirri, Jr.; Elizabeth Zampirri, both of 205 Wharton Rd., Mount Laurel, N.J. 08054

[21] Appl. No.: 970,284

[22] Filed: Nov. 14, 1997

[51] Int. Cl.[6] ..... A47G 9/06; B65D 33/28

[52] U.S. Cl. ..... 5/417; 5/418; 5/656; 5/484; 5/485; 383/4

[58] Field of Search ..... 5/417, 418, 420, 5/656, 484, 485; 383/4, 75

[56] References Cited

U.S. PATENT DOCUMENTS

| | | | |
|---|---|---|---|
| D. 258,035 | 1/1981 | Fenwick | 6/13 |
| 2,533,322 | 12/1950 | Kober | 135/16 |
| 4,278,719 | 7/1981 | Sarnecki et al. | 5/417 |
| 4,337,812 | 7/1982 | Trinkner | 150/11 |
| 4,347,629 | 9/1982 | Itoi | 2/108 |
| 4,634,618 | 1/1987 | Greer et al. | 5/417 |
| 4,709,430 | 12/1987 | Nicoll | 5/417 |
| 4,794,029 | 12/1988 | Tennant et al. | 428/101 |
| 4,856,912 | 8/1989 | Damus et al. | 383/4 |
| 4,991,978 | 2/1991 | Ostrowski | 383/4 |
| 5,072,467 | 12/1991 | Hunt | 5/417 |
| 5,103,515 | 4/1992 | Bird | 5/420 |
| 5,187,823 | 2/1993 | Ferguson et al. | 5/417 |
| 5,195,828 | 3/1993 | Bush-Rodriquez | 383/4 |
| 5,347,667 | 9/1994 | Schwarz et al. | 5/418 |
| 5,361,435 | 11/1994 | Reeves | 5/419 |
| 5,429,541 | 7/1995 | Landon | 446/70 |
| 5,443,880 | 8/1995 | Wike | 428/78 |
| 5,452,877 | 9/1995 | Riffle et al. | 248/511 |
| 5,482,374 | 1/1996 | Buhyoff | 383/4 |
| 5,499,411 | 3/1996 | Wong | 5/417 |
| 5,618,110 | 4/1997 | Sullivan | 383/4 |

*Primary Examiner*—Michael F. Trettel
*Attorney, Agent, or Firm*—Seidel, Gonda, Lavorgna & Monaco, PC

[57] ABSTRACT

An improved blanket and bag combination for camping, picnicking or traveling to the beach. The circular towel may be converted to form a large tote bag for carrying beach or camping items. When open, the blanket spans approximately 82" in diameter. The invention is two-sided, with one face of the blanket being absorbent cotton blend cloth material and the other face being repellant waterproof nylon. Thus, the invented apparatus can be placed with its waterproof face towards the ground to protect the wearer from dirt and debris. The cotton fabric side has an overall surface pattern that is consistent over the total area of one side of the bag.

Positioned approximately two-thirds away from its central point is a double drawstring channel. Velcro® closure pockets are situated beneath the double drawstring channel, towards the edge of the towel. The pockets, have waterproof lining and are located on the fabric side of the towel and are camouflaged by the blanket's overall surface pattern in such a manner to appear invisible.

A large grommet penetrates both sides of the blanket and can accommodate a standard size beach umbrella. A spring loaded clip is attached to the side of the blanket-bag or, alternatively, to its bottom center to engage the drawstrings to form a carrying strap.

11 Claims, 3 Drawing Sheets

FIG. 1A

MULTI-PURPOSE COMBINATION BLANKET AND TOTE BAG

FIELD OF THE INVENTION

The field of this invention relates to blankets used as a ground covers and, more particularly, ground cover blankets convertible into a tote bag.

BACKGROUND OF THE INVENTION

Blankets are typically used as ground covers to sit or lie on while camping, picnicking, sunbathing or other outdoor activities. The present invention may be used as a combination blanket to recline on and bag to transport items to and from the beach or campsite.

The dual purpose of a blanket which can be drawn closed via drawstrings into a tote is not new, and it is the subject matter of several patents including U.S. Pat. No. 5,187,823; U.S. Pat. No. 5,195,828; U.S. Pat. No. 4,794,029; U.S. Pat. No. 4,991,978; U.S. Pat. No. 4,337,812; U.S. Pat. No. 4,789,247; U.S. Pat. No. 4,738,545 and U.S. Pat. No. 2,479,203.

In particular, U.S. Pat. No. 5,195,828 discloses a blanket of nylon, cotton or other pliable fabric that has eyelets evenly spaced in pairs midway between the periphery and center and a drawstring through the eyelets. When closed by pulling the two ends of the drawstring, the center section of the blanket forms a carrying bag. A skirt is formed by the section between the eyelets and periphery, and extends over the bag to protect the user from the soiled or wet underside.

Similarly, U.S. Pat. No. 5,187,823 discloses a blanket or cover that may be configured into a bag. However, this patent includes a method of folding the cover and routing the drawstrings through rings or loops to create two backpack-type shoulder straps. The method of closure is defined as two opposing arcuate channel halves defining a circular channel. Two ropes are passed through the channel and exposed at the gaps created at the ends of each semicircle arc. Two retaining loops are located at the circumference. The bag is closed by pulling on the ropes to bunch the fabric and tying the ropes through the retaining loops to create shoulder straps.

Notwithstanding the prior art relating to combination blanket and tote devices, the present invention departs from these blanket-tote devices by providing a unique combination of features, such as a double channel, opposed drawstrings, top side pockets camouflaged by consistent, overall surface appearance of the top blanket surface. All of these features serve to distinguish the present invention from the prior art in the field, and are detailed with particularity below.

SUMMARY OF THE INVENTION

The present invention is a ground cover blanket that converts into a tote bag. The blanket comprises two pieces of fabric material substantially of identical circular dimensions sewn together around their periphery, one piece forming a top surface and the other piece forming a bottom surface when the blanket is spread on the ground. The two pieces are sewn together to form two adjacent, concentric, drawstring channels approximately two-thirds distance from the center point to the periphery of the fabric material. A drawstring is laced through each channel and has at least two opposed sections exposed to be grasped to draw the strings so that the blanket puckers into a closed bag configuration. The blanket contains at least one pocket situated between the fabric pieces. The pocket is positioned between the channels and the periphery, and has a pocket opening formed in the top surface of the blanket.

The blanket has absorbent, cotton-blend fabric on the top towel side that will be reclined upon and a water repellant nylon shell on the bottom side contacting the ground. The invention additionally differs from more traditional blanket-tote and towel-tote combinations in its unique use of a double-channel drawstring closure. Two circular channels are located at a radius extending approximately two thirds from the center to the outer rim of the towel. Two rope cords, one inside each channel, are used as drawstrings to pull the blanket closed to form a bag. An opposed pair of grommets on each channel exposes the drawstrings on the top towel side surface. By grasping the opposed drawstrings exposed between each pair of grommets, the blanket can be pulled closed into the tote bag configuration. When drawn into a bag configuration, the outer section between the drawstring channels and rim forms a slight skirt which hangs down along the outside of the bag with the towel cloth side outward. The unique double-channel drawstring closure facilitates a more streamlined conversion of the towel into the bag configuration without snagging or bunching of the draw cord.

When drawn closed, two side pockets are accessible (although hidden by the overall surface pattern of the cotton fabric side of the blanket, as described below) on the skirt area between the cotton and waterproof nylon layers. Although there have been other existing combination blanket-totes containing pockets, the pockets on the present blanket are uniquely waterproof to form a protective barrier to guard weather-sensitive personal possessions such as watches, jewelry and billfolds against water damage from exposure to the rain and sea.

Still another novel feature of the invention is the strategic placement and camouflage disguise of the pockets to make them difficult to detect to anyone who does not have knowledge of their existence. The pockets open on the top side of the blanket which has a busy pattern on it. The inner walls of the pocket are created by two swatches of waterproof nylon material, the same material as the ground cover side of the invention. The exposed, outer surface of the pocket has a second layer of toweling sewn on it of the same material and busy pattern that exists on the cotton surface of the invention.

Through careful alignment, the pockets are stitched in such a manner that the top surface fabric pattern is uninterrupted. The pockets have a Velcro® closure, with the opposing felt and tooth strips of material together comprising the Velcro® mechanism sewn to form a strip extending along the entire width of each side of the pocket opening. Thus, the surface pattern is consistently maintained over the entire cotton fabric surface, the surface that will be exposed to the eyes of passerbys. Through this precision alignment and consistent, unbroken detailing of pattern, the pockets are effectively "disguised" by the overall surface pattern of the fabric.

To ensure that the user does not have difficulty himself locating the pockets and can easily access these secret compartments, the pockets are strategically located beneath at least one pair of the double channel grommets. When drawn closed, the pockets are situated, Velcro® opening side upwards, at the top of the outer skirt which hangs around the bag. The camouflaging and particular location of the pockets on the cotton fabric side of the blanket, directly below the grommets, fulfill a dual purpose: The pockets remain on the exposed side of the blanket, when open, and are thus easily accessible; however, the pockets are at the same time masked by the overall pattern and are thus hidden.

It is another objective of the invention to optionally accommodate a beach umbrella. An enlarged plastic grommet is situated towards the rim of the blanket-tote invention. This grommet is sized to accommodate a standard size beach umbrella to be punched through its aperture and into the sand or ground beneath. A protective fabric flap covering may be placed over the grommet when not in use, so that sand or soil will not seep through the aperture. As with the novel double channel closure and camouflaged, waterproof pockets, this plastic grommet retainer umbrella holder presents still another unique feature distinguishing the present invention from the more traditional combination blanket and tote inventions.

Further advantages of the invention may be appreciated by reading the following descriptions.

BRIEF DESCRIPTION OF THE DRAWINGS

The drawings show a form of the invention which is presently preferred; however, the invention is not limited to the precise arrangement shown in the drawings.

DETAILED DESCRIPTION OF THE INVENTION

Figure 1:
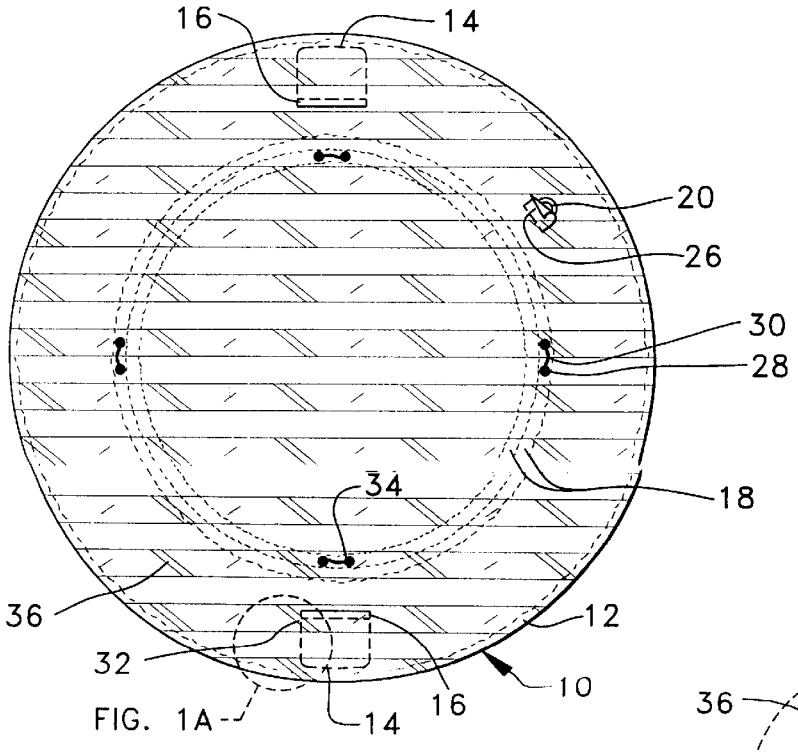
FIG. 1 is a top plan view of the combination towel and tote bag, and depicts a representational surface pattern that is uniformly applied on the cotton fabric side, which pattern operates to disguise the pockets, shown by phantom lines, located beneath the grommets.
Figure 2:
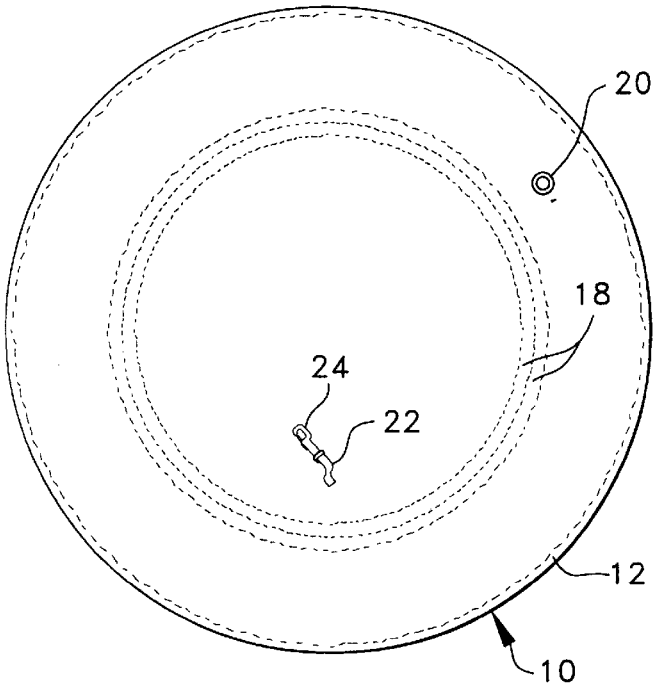
FIG. 2 is a bottom plan view, and depicts the waterproof nylon side of the combination tote and towel invention.

FIG. 1 shows the cotton-blend blanket side (10), in open position, of the circular-shaped combination blanket and tote bag invention. The cotton top side (10A) is attached to a waterproof nylon underside (10B) material, as shown in FIG. 2(10A), of the same circular dimensions, by a series of seams running parallel to the outer circumference of the invention. When open, the blanket preferably measures approximately eighty (80) inches in diameter.

The blanket has a weighted periphery (12) to assist in keeping dirt, sand or other ground debris from brushing up onto the blanket, when spread open, and additionally keep the blanket edges from flapping about in the seaside or mountain breezes. The weighted periphery (12) is obtained by the insertion of a thin, weighted cord (12A) into a single channel setting(12B) which extends around the full circumference of the blanket edge (10). The weighted cord is heavy enough to keep the blanket edges from curling up or flapping around in most weather conditions.

Located approximately one-third diameter from the periphery of the blanket are two adjacent, concentric drawstring channels (18) that form a complete circle around the towel surface. These channels are situated approximately two-thirds distance from the center of the blanket. The two channels are formed by three parallel sewn seams connecting the cotton fabric material on the top plan side to the waterproof nylon material situated on the bottom plan side of the invention. Within each channel is a drawstring rope cord (30), that is laced through one of the channels (18) and exposed on the cotton top side of the blanket via two opposing pairs of grommet openings (28). The channel setting provides an optimal housing for the two drawstring cords to reduce the friction and overall wear and tear that would occur between the cords rubbing together if located in a single channel. Having one drawstring laced through each channel and exposed by grommets at opposing ends of the blanket further allows easier closure of the blanket into a bag configuration. When all four portions of exposed drawstring between the four pairs of grommets are drawn closed, the blanket quickly and easily puckers into a closed tight bag configuration.

One set of opposing grommets is positioned along the inner channel (34), the other along the exterior channel (28). The two pairs of grommets situated along the inner channel (34) are positioned directly above a fabric pocket (14) on either side of the blanket.

At least one pocket (14) is positioned on either side of the blanket between the double drawstring channel (18) and the weighted periphery (12). The pocket comprises an inner lining sewn into the top and bottom fabric so that the pocket is located between these two fabric surfaces. The pocket opens on the top fabric surface of the blanket, and may be secured in a closed position by a strip of hook and loop fastening material, such as a Velcro® strip (16), running the width of the pocket. Because the pocket is made of the same fabric patterned material as the rest of the cotton blanket surface (36), the pockets are disguised and blend visually into the overall pattern of the tope surface. The inner grommets (34) act as identifiers to signal the location of the pocket to the wearer, to make these pockets more accessible to store and remove items from its compartments for the user of the blanket who knows of the relationship between the grommets and pockets situated directly beneath.

The pockets are lined with water resistant nylon material. Thus, personal possessions may be placed within the pockets away from exposure to the elements. The Velcro® strip (16) located along the top edge of the pocket enables the user to securely close the pockets and prevent sand from entering or personalty from falling out while the blanket is in use.

Figure 6:
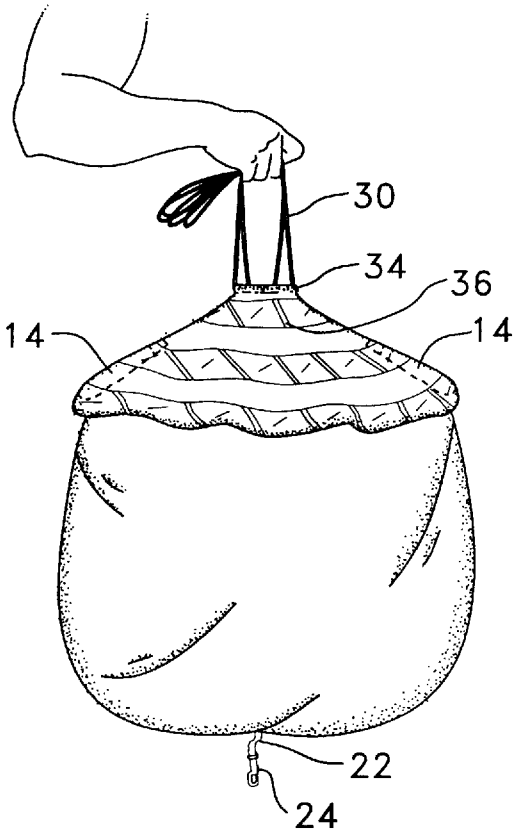
FIG. 6 is the view as shown in FIG. 5, with the drawstrings drawn closed and held shut manually.
Figure 5:
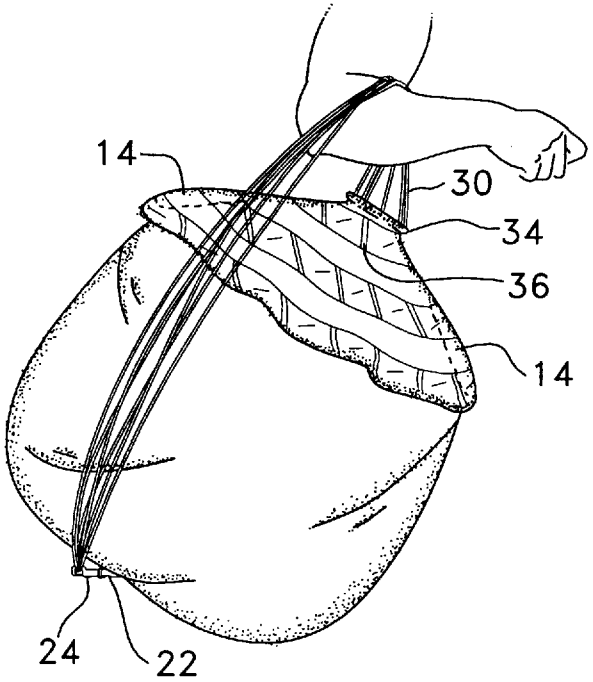
FIG. 5 is a view showing the invention when drawn closed into a bag configuration, with the drawstring closure (34) fastened to a hook located at the bottom center of the bag and held over the arm or, alternately, slung over the shoulder.

Because the pockets are positioned within the outer one-third surface area between the blanket periphery and drawstring channels, when drawn closed, the pockets remain easily accessible on the outside fringe of the bag when the blanket is reconfigured into the tote bag form (see FIGS. 5 and 6).

FIG. 1 further shows the pocket has an overall surface patterning and appearance consistent with an overall appearance of the top surface of the blanket side of the invention (36). The pattern is merely representational and the possible varieties of patterns are potentially limitless. This surface pattern functions as a camouflage to disguise the pocket (14) openings from view. As the pockets are strategically located beneath the grommets (34) on the blanket side of the invention, the user of the invention can quickly identify the location of the pocket formed in the top surface of the blanket.

Figure 1A:
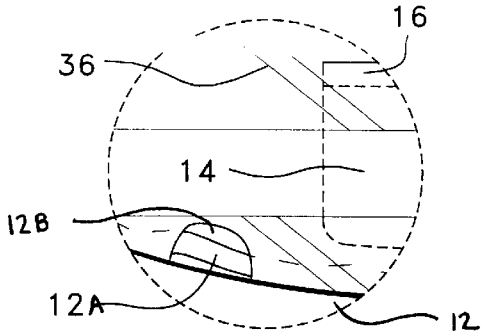
FIG. 1(A) is a blown up portion of FIG. 1, showing a representative pattern which is applied consistently over the blanket side of the invention and functions to camouflage the pockets.

FIG. 1(A) shows the function of the overall patterning and the weighted cord (12A) in the single channel (12B) sewn around the blanket's periphery (12) in greater detail. The pattern is consistently displayed over the entire top blanket surface.

A large plastic grommet (20) is situated approximately one-fifth of the way from the perimeter of the towel and pierces directly through both fabric and waterproof nylon sides of the blanket. The grommet functions as an umbrella holder or brace, so that the user may securely anchor the umbrella to fit right against the blanket and sit in the shade. On the towel side of the blanket, a piece of fabric material, the same material and patterning as the entire top towel side of the invention, forms a protective cover flap (26), which may be used to cover up the grommet to prevent sand or dirt from entering the hole and soiling the blanket when not in use as an umbrella holder.

FIG. 2 shows the combination blanket and tote invention from the bottom plan view. The bottom surface consists of a waterproof nylon material (10A). The pocket and double channel grommet openings are not visible from the bottom side. The fabric stitching around the weighted periphery (12) and outlining the two adjacent, concentric channels are visible from this side. The plastic grommet (20) umbrella holder also penetrates the bottom fabric surface of the blanket.

FIG. 2 additionally features a clip (24) positioned approximately midway between the center and the edge of the blanket. An elastic loop (22) attaches with one end sewn to the nylon fabric of the bag exterior and the other end is fastened to the clip to hold it in place. The elastic loop allows the clip to be moved and shifted under the blanket to a comfortable position to lie upon without ripping the fabric of the blanket. When the blanket is drawn shut by pulling the drawstrings in the two channels into a bag configuration, the wearer can loop the drawstrings into the clip device to create a strap or handle which may be carried over the arm (see FIG. 5) or over the shoulder (not illustrated). When the clip is engaged with the drawstrings, the drawstrings may be split into pairs and worn on each shoulder in the form of a back pack (not illustrated). There are limitless other possibilities of wearing the tote by using the clip to engage the drawstrings, as well as a variety of uses for the clip alone, such as for use as a key chain, to hold sandals, a sand pail, or any other item that may fit in the clip.

Figure 3:
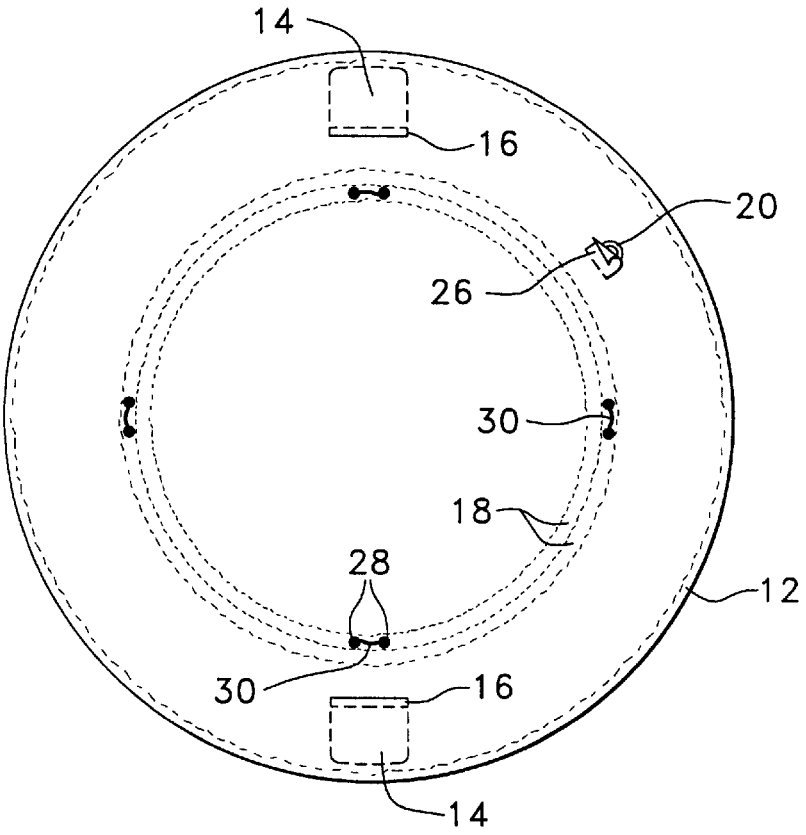
FIG. 3 is the top plan view as shown in FIG. 1, showing all details of the invention from this perspective but without the camouflaging overall surface pattern.

FIG. 3 clarifies the features present in FIG. 1, without the overall appearance of the top surface to camouflage the pocket opening from view.

Figure 4:
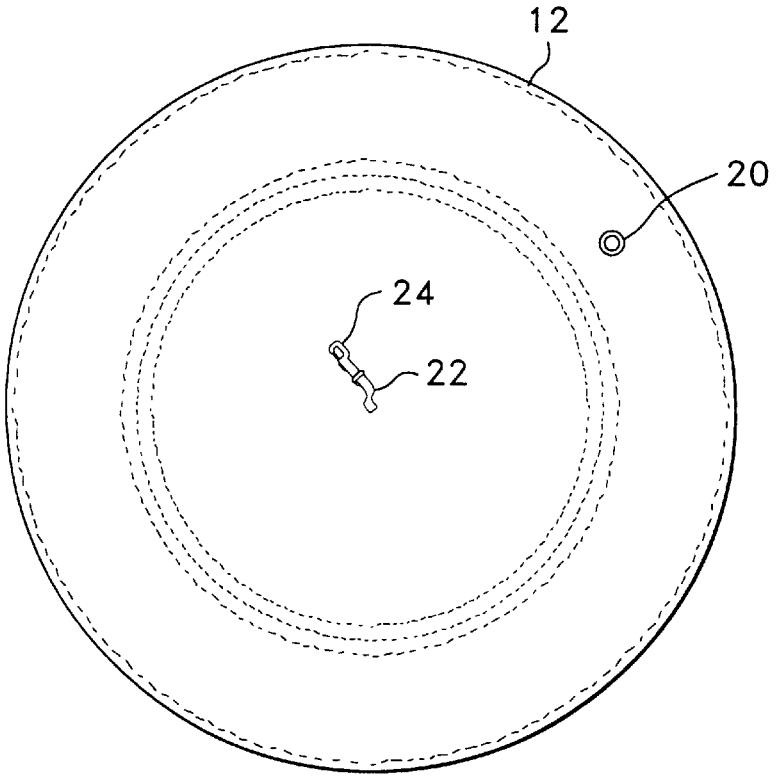
FIG. 4 is an alternate embodiment of the bottom plan view as shown in FIG. 2, and showing the hook bag closure (24) in its alternate location.

FIG. 4 depicts an alternate embodiment of FIG. 2 in which the clip (24) and elastic loop (22) are mounted to the center point of the bottom surface of the blanket. By fastening the drawstrings into the clip (24) positioned at the bottom center of the bag, and drawing the bag closed, the drawstrings create a strap which is significantly shorter in length and can be more easily worn by persons with shorter arms, such as children. This shortened strap configuration may also be ideally suited to be worn by persons who do not desire to have the bag hanging too low, such as bikers attaching the bag to their bicycle seats when traveling to and from the beach, mountains or campsite.

The blanket is drawn into a bag by grasping the portions of the drawstrings positioned between the four pairs of grommets in the dual channel setting and pulling on the strings. Prior to such closure, items to be carried are placed within the center of the bag. Once the drawstrings are pulled, the weight of these items within the towel provide extra tension to additionally pull the grommets and fabric downwards and assist the smooth conversion of the blanket-to-bag form.

FIGS. 5 and 6 offer a general representation of the bag once pulled shut and carried by the wearer, either manually holding the drawstrings, or with the drawstrings fastened to the clip. A slight fringe is formed by the top of the blanket above the dual channels when the opposed drawstring sections are grasped and the blanket puckers into the closed configuration. What has been the underside waterproof nylon portion of the bottom surface of the blanket has now become the outside of the bag.

The purpose of the dual channel being positioned in such a manner as to allow roughly a third of the blanket to hang around the bag like a fringe is to allow the approximately 82" blanket to convert into a fairly small, compact bag to be easily carried by the wearer. Additionally, the fringe further allows any sand or soil that may have been on the edges of the towel to be easily brushed off and fall to the ground instead of falling into the bag and dirtying its contents. The pocket opening formed in the top surface of the blanket, when drawn closed, is not situated on the exposed fringe.

This invention may be embodied in other specific forms without departing from its spirit or essential attributes. Accordingly, reference should be made to the following claims, rather than to the foregoing description, in order to determine the fuller scope of the invention.

We claim:

1. A ground cover blanket convertible into a tote bag, comprising:

(a) two pieces of fabric material of substantially identical circular dimensions sewn together around their periphery, one piece forming a top surface and the other piece forming a bottom surface when the blanket is spread on the ground;

(b) the two pieces being further sewn to form two adjacent, concentric, drawstring channels approximately two-thirds distance from the center point to the periphery of the fabric material;

(c) a drawstring laced through each channel and having at least two opposed sections exposed to be grasped to draw the string so that the blanket puckers into a closed bag configuration;

(d) at least one pocket situated between the fabric pieces and positioned between the channels and the periphery, and having a pocket opening formed in the top surface of the blanket.

2. The blanket of claim 1, wherein the pocket comprises an inner lining sewn between the top and bottom fabric.

3. The blanket of claim 1, wherein the pocket opening is formed to visually blend into the top surface to camouflage the pocket opening from view.

4. The blanket of claim 3, wherein the pocket is secured in a closed position by a strip of hook and loop fastening material extending along the pocket opening.

5. The blanket of claim 1, wherein the top fabric piece is a cotton blend material, and the bottom fabric piece is a water resistant nylon material.

6. The blanket of claim 1, further comprising a single peripheral channel extending around the circumference of the blanket containing a weighted cord therein to weight down the blanket edge.

7. The blanket of claim 1, further comprising a clip on the bottom surface for fastening the drawstrings together to form a shoulder strap when the blanket is drawn into a tote.

8. The blanket claim of 7, in which the clip is the center of the bottom surface.

9. The blanket claim of 7, in which the clip is between the center and the drawstring channels on the bottom surface.

10. The blanket of claim of 1, further comprising an umbrella holder and protective cover flap.

11. The blanket of claim 10, wherein the umbrella holder consists of a plastic grommet with an opening that accommodates a standard size umbrella pole.

* * * * *